United States Patent [19]

Baird

[11] Patent Number: 4,884,439

[45] Date of Patent: Dec. 5, 1989

[54] HYDRAULIC CIRCUIT FOR USE IN WIRELINE FORMATION TESTER

[75] Inventor: Gary K. Baird, Richmond, Tex.

[73] Assignee: Halliburton Logging Services, Inc., Houston, Tex.

[21] Appl. No.: 301,415

[22] Filed: Jan. 26, 1989

[51] Int. Cl.[4] ..... E21B 49/10

[52] U.S. Cl. ..... 73/155; 73/863.01; 73/864.63; 166/264

[58] Field of Search ..... 73/151, 155, 152, 864.63, 73/864.15, 863.86, 863.01; 166/250, 264, 100; 137/2; 251/900

[56] References Cited

U.S. PATENT DOCUMENTS

| | | | |
|---|---|---|---|
| 4,339,948 | 7/1982 | Hallmark | 73/155 |
| 4,375,164 | 3/1983 | Dodge et al. | 73/154 |
| 4,593,560 | 6/1986 | Purfurst | 73/155 |
| 4,676,096 | 6/1987 | Bardsley et al. | 73/155 |
| 4,829,835 | 5/1989 | Welker | 73/155 |

*Primary Examiner*—John Chapman
*Assistant Examiner*—Kevin D. O'Shea
*Attorney, Agent, or Firm*—William J. Beard

[57] ABSTRACT

A formation tester is set forth. It incorporates a probe having a surrounding elastomeric seal and snorkel for extension into formations. The probe connects with a sample line into the formation tester. On the sample line, a pressure sensor responds to pressure observed in the sample line and provides a signal for use in control of a motor controller opening and closing relative to hard valve elements and valve seats in a choking action to control flow in the sample line. The sample line then goes to a soft seat valve assembly having a valve element and a seat which delivers controlled sample flow into a chamber for storage within the formation tester.

10 Claims, 1 Drawing Sheet

HYDRAULIC CIRCUIT FOR USE IN WIRELINE FORMATION TESTER

BACKGROUND OF THE DISCLOSURE

After an oil well has been partly drilled and suspected producing formations have been penetrated, it is necessary to make various tests to determine production possibilities of various formations. One of the test techniques involves the use of a tool which is known as a formation tester. An exemplary formation tester is set forth in U.S. Pat. Nos. 4,375,164 and 4,593,560 assigned to assignee of the present disclosure. As set forth in those disclosures, the tool is adapted to be lowered into the well bore, supported on an armored logging cable enclosing certain conductors for providing surface control for the tool. The logging cable extends to the surface and passes over a sheave and is spooled on a reel or drum. The conductors in it connect with suitable surface located power supplies, controls, and recorder. The formation tester is lowered to a specified depth in a well. At that elevation, a backup shoe is extended on one side of the formation tester and formation testing apparatus is extended diametrically opposite into the formation of interest. The equipment so extended normally includes a surrounding elastomeric sealing pad which encircles a smaller extendible snorkel which penetrates a formation as the formation will permit, up to a specified depth. The snorkel is ideally isolated from fluid and pressure in the well to be able to test the formation. The snorkel is extended into the formation to enable direct fluid communication from the formation into the tool. Moreover, it is isolated from invasion of the well borehole fluid and pressures therein to permit a pressure sensor to obtain formation pressure. Further, a sampling chamber elsewhere in the formation tester can be selectively connected through the snorkel by suitable valves to obtain delivery of a fluid sample from the formation. The fluid sample typically may include a relatively small sample which is a pretest sample, and if that is acceptable, a larger sample can be drawn through the snorkel. Various pretest and sample volumes are selected and determined under control from the surface.

Testing procedures require a substantial interval. For instance, isolation steps must be undertaken to assure that the formation tester properly obtains data from a single formation without invasion of other well fluids from different strata. These procedures involve extension and retraction of the packer and snorkel described above. These steps are normally accompanied by the extension of certain backup shoes which set backup shoes on the opposite side of the formation tester in the borehole Thus, the references noted above describe apparatus which extends the snorkel on one side of the tool body and which extend backup pistons on the opposite side to assure that adequate force is delivered to position the snorkel in the formation of interest.

Ideally, test procedures are conducted as rapidly as possible to assure that the tests are conducted at a minimum cost in rig time.

One of the steps carried out by the formation tester is extension of the snorkel and surrounding pad which achieves a seal to isolate the formation. Additionally, backup pistons are extended, thereby assuring that backup shoes are anchored in the well borehole.

The present invention is directed to an improved system including a hydraulic circuit within the formation tester which assures that the packer surrounding the snorkel maintains a proper seal and is not subjected to formation erosion in unconsolidated formations. Assume that a sample is to be taken form an unconsolidated formation. A probe is extended on the end of a snorkel into that formation. The formation is held in place by a surrounding elastomeric seal confronting the formation. The probe enters the formation, begins production of formation fluids through the probe, and continues for an interval. In the immediate zone near the snorkel, loss of fluid may cause sloughing of the formation which may erode in the vicinity of the seal contact. If this occurs, fluid at higher pressures within the well borehole may cause very substantial, almost instantaneous erosion around that seal, and flood the region near the snorkel probe and thereby damage the formation, potentially mixing with the sample taken through the probe and causing problems with formation tester withdrawal. The seal is thus undercut by erosion, and raising doubts about the integrity of the sample captured from that particular formation.

A related problem which arises from unconsolidated formations is the abrasive nature of formation particles (typically sand-like particles) which are produced. The connate formation fluids will carry particles through the probe and into the formation tester. When this occurs damage directly results to the various valves in the hydraulic system for control of the formation tester. The abrasive particles with the formation fluid typically will erode the valve seats or valve elements of valves in the hydraulic circuitry. This erosion problem can create difficulties. For instance, once the combination of valve element and valve seat has been eroded to the degree where leakage occurs across the seat, then either incorrect pressure measurements will be obtained or improper filling of the sample container in the formation tester might occur. In any event, repairs are difficult ordinarily to implement and the formation tester must be repaired.

The present apparatus is directed to a formation tester which accomplishes sampling where the sample is obtained through two valves in series. The first valve serves an entirely different function than the second valve. The two valves are used jointly to prevent problems as described above. A first valve is serially connected with the probe on the snorkel. The sample is introduced to the first valve and sample pressure is detected by a pressure sensor. A motorized valve equipped with a hard seat in conjunction with the valve element is adjusted in position so that a choking function of fluid flow is accomplished. The pressure sensor provides an uplink signal along the logging cable to the surface so that pressure is known. Formation pressure foreknowledge enables preliminary setting of the first valve by means of a downlink signal sent to a motor controller which adjusts the opening of the first valve. This preliminary adjustment prevents large differential pressures from occurring across the face of the seal around the snorkel and thereby reduces, indeed even prevents, erosion of the formation sand around the elastomeric snorkel seal. The first valve can be opened to different choking positions to thereby change the flow rate in part dependent on the pressure measurement obtained by the pressure sensor. Since a complete seal is not required of the first valve, maintenance is reduced because it is not required to close on fluid flow which is laden with abrasive particles. A second serial valve is included. It is driven by a solenoid so that it switches between open and closed positions. The second valve opens into the sample storage chamber. This valve is constructed with a soft seat arrangement. It is open and closed in a binary fashion so that the storage chamber can be easily isolated. In the event that closure on abrasive particles in the fluid flow produces damage, it is preferably constructed so that the soft wearing component is easily removed and service can be quickly accomplished. Accordingly, the first and second valves arranged in series provide protection of the valving system.

So that a more complete understanding of the present apparatus can be obtained, attention is directed to the detailed description below, which, when considered in conjunction with the drawings, sets forth the present apparatus in substantial detail.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figures 1, 2:
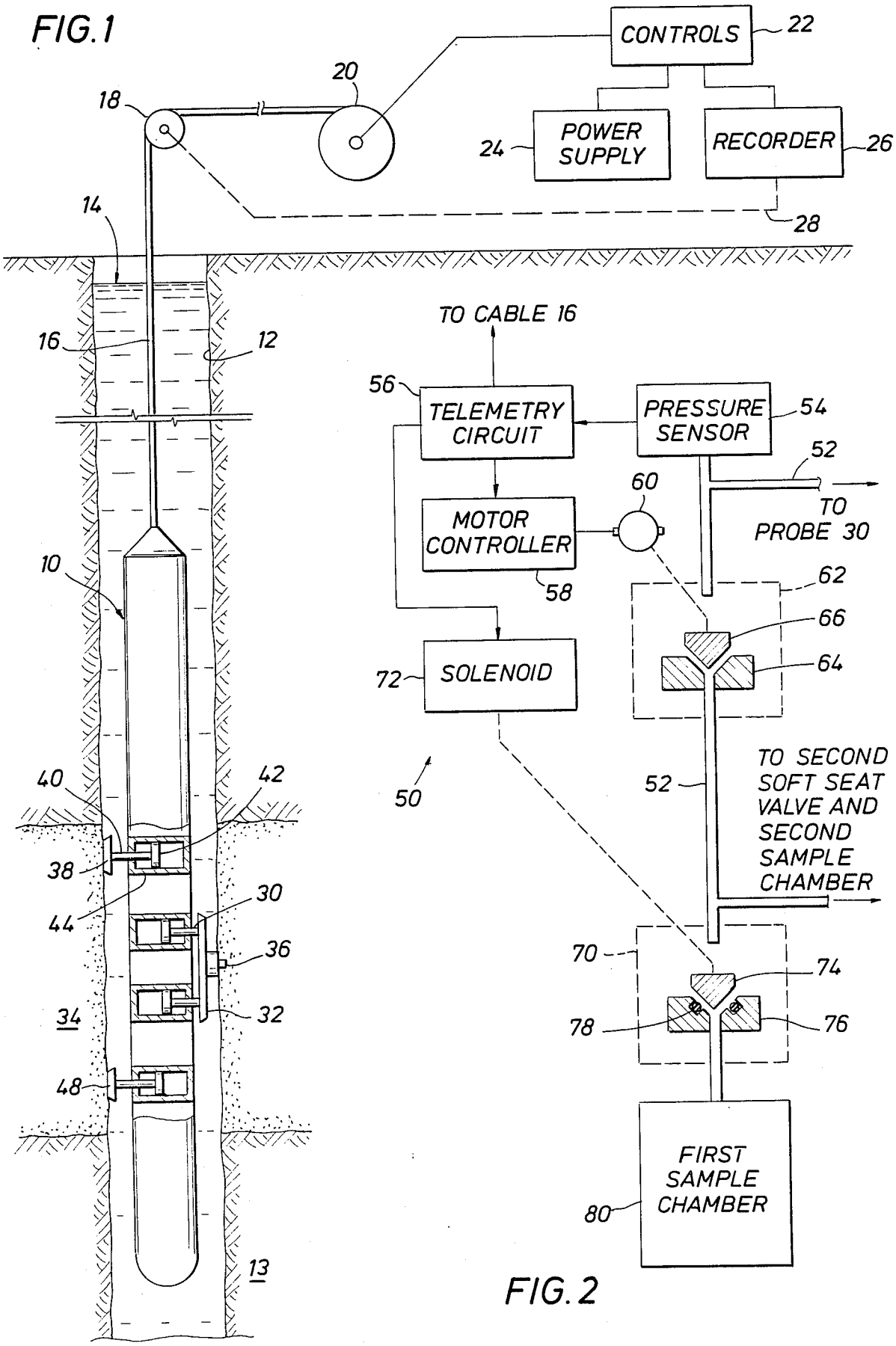
FIG. 1 shows a formation tester suspended in a well borehole for conducting formation tests wherein a snorkel is extended into the formation and backup shoes support the formation tester during the test and further including a tool hydraulic system for operation.
FIG. 2 is a hydraulic schematic showing the improved valving system for use in the formation tester of the present invention.

Attention is first directed to FIG. 1 of the drawings where the numeral 10 identifies a formation tester constructed in accordance with the teaching of this disclosure. It is supported in a well borehole 12 which is shown to be open hole. The tool 10 typically operates by testing a formation penetrated by open borehole and to this end, no casing has been shown in FIG. 1. Typically, the well is filled with drilling fluid which is known as drilling mud, and the column of drilling mud is identified at 14. The formation tester 10 comprises an elongate cylindrical body of substantial length and weight. It is supported on an armored cable known as a well logging cable. Suitable electrical conductors are enclosed in the cable, the cable being identified by the numeral 16. The cable extends to the surface and passes over a sheave 18. The cable 16 is stored on a drum 20. The cable might be several thousand feet in length to test formations at great depths. Conductors from the cable 16 are connected with various and sundry controls identified at 22. The electronic control equipment and the formation tester are provided with power from a power supply 24. The signals and data obtained from the formation tester 10 are output through the surface located equipment and to a recorder 26. The recorder records the data as a function of depth. An electronic or mechanical depth indicating mechanism is connected to the sheave 18 and provides depth measurement to the recorder 26 and is thus identified by the numeral 28.

Referring now the tool body, it will be first observed that it supports a laterally extending probe which is identified by the numeral 30. The probe 30 is supported to extend from the tool body. The extended probe is surrounded by a ring of elastomeric material 32. The ring 32 is a seal pad. It is pliable, and is affixed to the probe 30 for sealing operation. Moreover, the ring 32 operates as a seal when pressed against the adjacent formation. Assume the formation 34 adjacent to the tool is suspected to have fluids of interest. This formation 34 is tested by extending a snorkel 36 into the formation. The probe 30 is extended against the formation. When the seal 32 is pressed against the formation 34, the seal prevents invasion of open hole pressure or drilling fluids into the vicinity of the extended snorkel 36. It is important to isolate the snorkel tip from the invading fluids or pressure so that data obtained from the formation 34 is unmodified by the intrusion of a well borehole.

This sequence of operation involving extension of the snorkel 36 into the formation typically occurs after backup shoes and the sealing pad are positioned, and an equalizing valve in the tester is closed. The numeral 38 identifies a top backup shoe which is supported on a piston rod 40. The piston rod 40 extends diametrically opposite the snorkel 36. The snorkel 36 extends on one side of the tool body while the backup shoe is on the opposite side. The piston rod 40 which supports the backup shoe is connected with a piston 42 in a hydraulic cylinder 44. The cylinder is preferably provided with hydraulic fluid from both ends so that the piston 42 is double acting; that is, the piston rod 40 is extended under power and retracted under power. As will be observed, the backup shoe 38 is above the snorkel 36. A similar backup shoe 48 is also included below the snorkel. Preferably, the backup shoes 38 and 48 are evenly spaced above and below the snorkel 36. Moreover, they are operated by hydraulic power simultaneously applied for extension of the probe 30. This assures that the seal 32 has loading on it to achieve the pressure seal to prevent intrusion of well fluids and pressure into the formation 34. The backup shoe 48 is supported on a similar piston rod and operates in the same fashion, preferably being connected and a parallel with the other backup shoe so that the two operate together.

DETAILED DESCRIPTION OF THE HYDRAULIC CIRCUITRY

FIG. 2 of the drawings shows a portion of the hydraulic circuitry which is incorporated for operation of the formation tester 10. The hydraulic circuitry is identified generally by the numeral 50. The numeral 52 identifies a sample flow line which connects from the probe 30. It introduces the sample fluid which is to be collected in the formation tester. This line 52 connects with a pressure sensor 54. That measures the instantaneous pressure observed in the line 52. If the probe is operatively connected into the formation undergoing testing, pressure levels are achieved in the line 52 which correspond to the pressures observed in the formation. This pressure is truly reported to the sensor 54 accurately, assuming that there is no sloughing or collapse of the unconsolidated formations around the elastomeric seal 32. One of the purposes of the present apparatus is to protect that seal.

The pressure transducer 54 forms a pressure reading. This reading is transferred to the telemetry circuit 56. That circuit is connected with a conductor in the logging cable 16 so that the signal is transmitted to the controls at the surface to provide an indication either by hand or by automatic response, the pressure which is transmitted through the uplinking of the telemetry system leads to the creation of a return signal on the logging cable 16. That return signal provides a control system for a motor controller 58. That signal is delivered through the motor controller and to a motor 60. The motor 60 operates a first valve 62 as will be described.

The first valve is connected serially in the sample line 52. The first valve includes a valve body which has been represented schematically in FIG. 2 of the drawings. The valve also incorporates a valve seat 64. This is preferably formed of hard material. A valve element 66 is likewise included and is also formed of hard material. The members 64 and 66 are brought together to block flow. The valve element 66 is adjustable so that it can move from one position to another. This feature permits choking the flow so that it can be modulated. The motor 60 is operated to adjust the modulation. If desired, the motor 60 can be operated so that the valve is completely closed by positioning the valve element 66 snugly in the seat 64. The normal operation, however, is in response to the pressure sensed by the pressure sensor 54 so that fluid flow is controlled. In general terms, fluid flow is strictly limited so that the unconsolidated formation will not collapse.

The sample line 52 extends to a second valve at 70. The valve 70 is also operated by a signal from the surface. The telemetry circuit 56 connects with a solenoid operator 72. The operator 72 is switched so that the valve 70 is either open or closed. The second valve 70 incorporates a valve seat 76 which is positioned in conjunction with a valve element 74 for complete closure. This valve assembly 70 is described as a soft seat valve mechanism. A replaceable seat element is incorporated at 78. It is shown in the preferred form as a removable O-ring. A Chevron resilient packing ring can be used alternatively. Other types of soft seat valves can be likewise used. The valve 70 is constructed so that it can close completely by compressing the seal ring on closure of the valve element against the seat. The solenoid 72 thus drives the soft seat valve assembly 70 to a full open or a full closed position as rapidly as possible. The valve 70 is connected with a first sample chamber 80 which is filled when both the valves 62 and 70 are opened.

AN EXAMPLE OF OPERATION

Assume that the formation tester 10 is lowered into an open hole well in the fashion shown in FIG. 1 opposite of formation 34 which is likely to be unconsolidated materials. Assume further, that the probe 30 is extended so that the resilient seal ring 32 is seated against the formation. The snorkel 36 is extended, puncturing the unconsolidated formation, and misplacing a small portion of the materials in the formation. Assume also that the pressure at this depth in the borehole 12 is known, that the formation pressure is not known. The probe 30 is open so that formation fluid pressure is introduced into the sample line 52. Assume that the initial condition finds the valve 70 completely closed; in that event, pressure at the sensor 54 will rise quickly to formation pressure which can be measured by the sensor, conveyed to the telemetry circuit 56, and transmitted up the logging cable 16. Decisions can be made as a result of the pressure reading so that fluid flow can then be then safely received into the tool. In general terms, it is desirable that formation pressure equal to the pressure in the open well at that depth. However, the two pressures are preferably kept relatively close to one another so that there is very little differential pressure drive causing collapse. The testing procedure is carried out with controlled drainage of the formation 34, all with a view of preventing collapse of the unconsolidated formation. Fluid flow is delivered under control of the valves 62 and 70.

Choking flow through the first valve is accomplished by using the motor 60 to adjust the location of the valve element 66, and thus control flow is permitted. The first valve 62 has a long life in operation. It is ideally never closed on a fluid flow, especially a fluid flow which is susceptible of abrasive particles. Rather, it is moved to and from for choking action. That is, the valve element 56 is adjusted in the valve seat so that choking of the fluid flow is accomplished thereby.

After the fluid travels past the valve 62, it next must travel through the valve 70 and into the sample chamber 80. The valve 70 is normally fully open or fully closed. On closure, the seat and valve element close together, but wear is reduced, substantially avoided, because a soft seat construction is used. In the illustrated embodiment, this has the form of an insert, either a Chevron packing or O-ring, which is positioned between the valve element and the valve seat. When the valves 62 and 70 are both open the sample chamber 80 is filled. The valves are controlled so that overfilling is avoided.

At the time of closing the valves, the valve 62 is partially choked first to reduce the flow rate, and the soft seat valve 70 is thereafter operated. This does not create a great deal of risk or cause significant damage to the valve 70 because the exposure to particulate matter in the fluid flow is markedly reduced by closing that valve secondly. When it closes, it may close on a few particles, but this no detriment to operation. The typical formation tester 10 incorporates first and second sample chambers Accordingly, the valve 70 and the chamber 80 are duplicated. The terms hard and soft are relative terms referring to materials involved in the valve element and valve seat. The hard materials are typically steel, and often heat treated steel parts. The soft materials are typically seal rings of rubber or elastomeric plastic materials which are worn out and replaced easily. The soft materials can also be washers mounted on the seat or valve element in a facing position. While the foregoing is directed to the preferred embodiment, the scope thereof is determined by the claims which follow.

What is claimed is:

1. For use in a formation tester supported on a well logging cable and suspended in a well borehole, a formation tester having an extendible probe therein wherein the probe connects to a sample line and the sample line delivers a formation sample, the formation tester comprising:

(a) a series choke means in said sample line for controlling the rate of sample flow through said sample line;

(b) valve means having a valve element and valve seat cooperatively closing together to block flow through said sample line, and wherein said valve means includes a relatively soft component;

(c) fluid sample storage means for receiving samples from said sample line for storage.

2. The apparatus of claim 1 wherein said choke means comprises a valve means having a movable valve element positioned relative to a valve seat and said element and valve seat are formed of relatively hard materials.

3. The apparatus of claim 1 including a motor controller having an operative connective link with said valve element and valve seat to relatively move toward closure thereof.

4. The apparatus of claim 3 wherein said choke means comprises a valve means having a movable valve element positioned relative to a valve seat and said element and valve seat are formed of relatively hard materials.

5. The apparatus of claim 4 wherein said motor controller operates a motor connected to said valve element for movement thereof.

6. The apparatus of claim 5 wherein said choke means has an output connected to a second valve means and said second valve means has a relatively soft component.

7. The apparatus of claim 1 wherein said valve means includes a relatively soft removable and sacrificial insert between a valve element and valve seat, and a flow path past said valve seat into said sample chamber means.

8. The apparatus of claim 7 including a pressure sensor connected to said sample line.

9. The apparatus of claim 8 including means connecting said pressure sensor to a telemetry circuit for converting the signal therefrom into a signal for transmission of a logging cable for suspending the formation tester in a well borehole.

10. The apparatus of claim 9 including means for directing a control signal to said telemetry circuit, and wherein said telemetry circuit connects with solenoid control means for operation of said valve means.

* * * * *